US006417432B1

(12) United States Patent
Downing

(10) Patent No.: US 6,417,432 B1
(45) Date of Patent: Jul. 9, 2002

(54) MYMI FREE FLOATING DRUM

(76) Inventor: Michael J. Downing, 87 Woods Dr., Clinton Corners, NY (US) 12514-2550

( * ) Notice: Subject to any disclaimer, the term of this patent is extended or adjusted under 35 U.S.C. 154(b) by 0 days.

(21) Appl. No.: 09/873,856

(22) Filed: Jun. 4, 2001

(51) Int. Cl.[7] ..... G10D 13/02
(52) U.S. Cl. ..... 84/411 R; 84/411 R; 84/413; 84/411 A
(58) Field of Search ..... 84/411 R, 413, 84/411 A

(56) References Cited

U.S. PATENT DOCUMENTS

| | | | | |
|---|---|---|---|---|
| 4,295,405 A | | 10/1981 | Sleishman | 84/413 |
| 4,334,458 A | | 6/1982 | Grauso | 84/411 |
| 4,570,526 A | | 2/1986 | Hoshino | 84/413 |
| 4,660,455 A | * | 4/1987 | Jones et al. | 84/413 |
| 4,714,002 A | | 12/1987 | Cleland | 84/413 |
| 4,869,146 A | * | 9/1989 | Bonsor | 84/413 |
| 5,357,838 A | | 10/1994 | Kurosaki | 84/413 |
| 5,413,022 A | | 5/1995 | Sleishman | 84/413 |
| 5,447,087 A | | 9/1995 | Hawes et al. | 84/413 |

OTHER PUBLICATIONS

Drum Shells, Modern Drummer, Where It All Starts, Sep. 1993, Woody Thompson 108–112.
Understanding Drums Jun. 1985, Modern Drummer, Paul Matcott, 58–64.
Drums: An Engineering Analysis, Modern Drummer, Spiro A. Psarris, Part I 68 & 69, Part II 50 & 51.

* cited by examiner

*Primary Examiner*—Robert E. Nappi
*Assistant Examiner*—Kim Lockett

(57) ABSTRACT

A musical drum 40 which utilizes a principle of physics to achieve an unequal tensioning of the upper head 20 and the lower head 36 without the need of physical attachments or piercing of the drum shell 24. The shell of the drum 24 remains suspended by shell's bearing edge 26, in contact only with the upper and lower heads 20 and 36 respectively. This allows the shell 24 of the drum to resonate freely and unencumbered by any attachments of hardware.

3 Claims, 5 Drawing Sheets

MYMI FREE FLOATING DRUM

BACKGROUND—FIELD OF INVENTION

Figure 1:
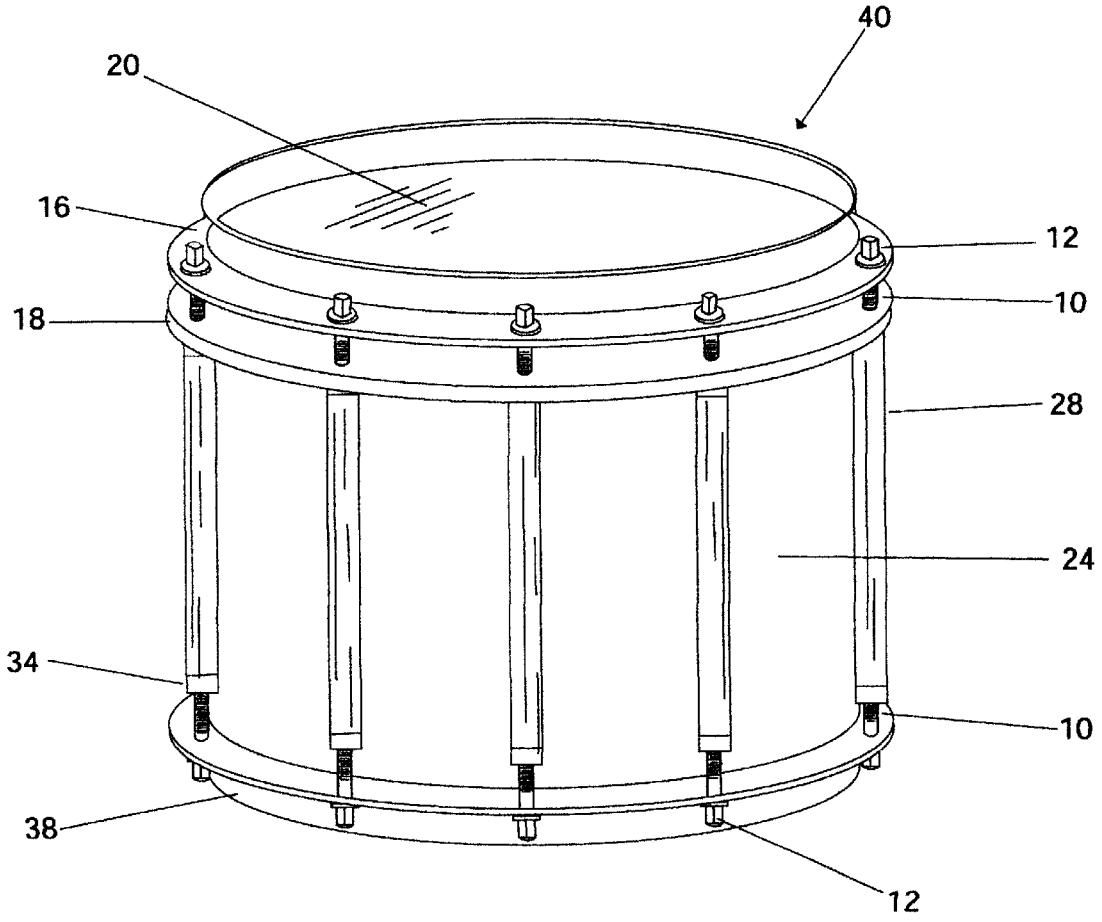

This invention relates to musical drum construction. In particular, the invention herein employs a principle of physics to achieve a variation of tensioning between the upper and lower heads of said drum without physical attachments of lug hardware or piercing of the drum shell in any manner and thus allowing the shell to vibrate freely.

BACKGROUND—DESCRIPTION OF PRIOR ART

Musical drums are found in numerous varieties the world over and since the earliest times. Evidence of drums date back to the third millennium in Egyptian art of 1800 B.C. and drums were mentioned in Chinese poems of 1135 B.C.

A conventional musical drum generally consists of two heads (diaphragms or skins) on a cylindrical body. This construction allows the vibration on one head to be transferred through the air inside the drum shell to the other head and cause such other head to also vibrate. The drum heads or skins are held in place over the end of the drum shell by drum hoops or rims.

A plural of turning screws pass through apertures in each rim and are screwed into fixed brackets which are mounted at uniformly spaced positions around the drum shell. Tuning of the drum is accomplished by turning the screws into the bracket. This operation serves to draw the drum rim down over the end of the drum shell, thereby applying tension to the drum skin, which is thus stretched over the end of the drum shell.

In most conventional drum systems, the drum rims, which hold the drum head in place, are connected to the drum shell by direct physical attachment. This attachment generally involves piercing, i.e. drilling holes into the drum shell at numerous points. This is illustrated in many U.S. patents such as U.S. Pat. Nos. 274,900; 1,284,526; 1,344,344; 1,420,233; 2,548,271; 3,019,685; 3,435,723; 3,439,573; 3,533,324; 3,647,931; 3,724,313; and 3,911,779.

The main source of sound from a conventional drum is the vibration of the drum head as a result of being struck by the drumstick or the like sympathetic induced vibration in the diametrically opposed drum head. Ignorance in the design of conventional drums systems is the utilization of the shell as source of residual vibration to add to the tone and output of the drum, if the shell were to be allowed to freely resonate. The aforementioned direct physical attachment of the drum hoops to the shell serves to dampen and eliminate shell vibration.

It seems that there should be a simple solution to achieve a free-floating shell that can resonate without direct physical attachment. One way would be to place the drum head and rims on opposite ends of the shell and link them together directly therefore suspending the shell in a sandwich effect. This would give you a shell that will resonate freely but the ability to tension the upper and lower heads to different degrees of rigidity to each other would be lost. Many previous attempts to achieve a true suspended shell and independent tension have failed.

Australian Patent Specification No. 4,295,405. Date: Oct. 20, 1981. Donald Sleishman (U.S. patent application Ser. No. 82,462) Concerns a musical drum in which the loading means attaching the drum head to the shell is connected to the shell at various points on the inner surface of the shell. This design requires piercing the drum shell as clearly shown in FIGS. 3, 4 and 6.

Figure 4:
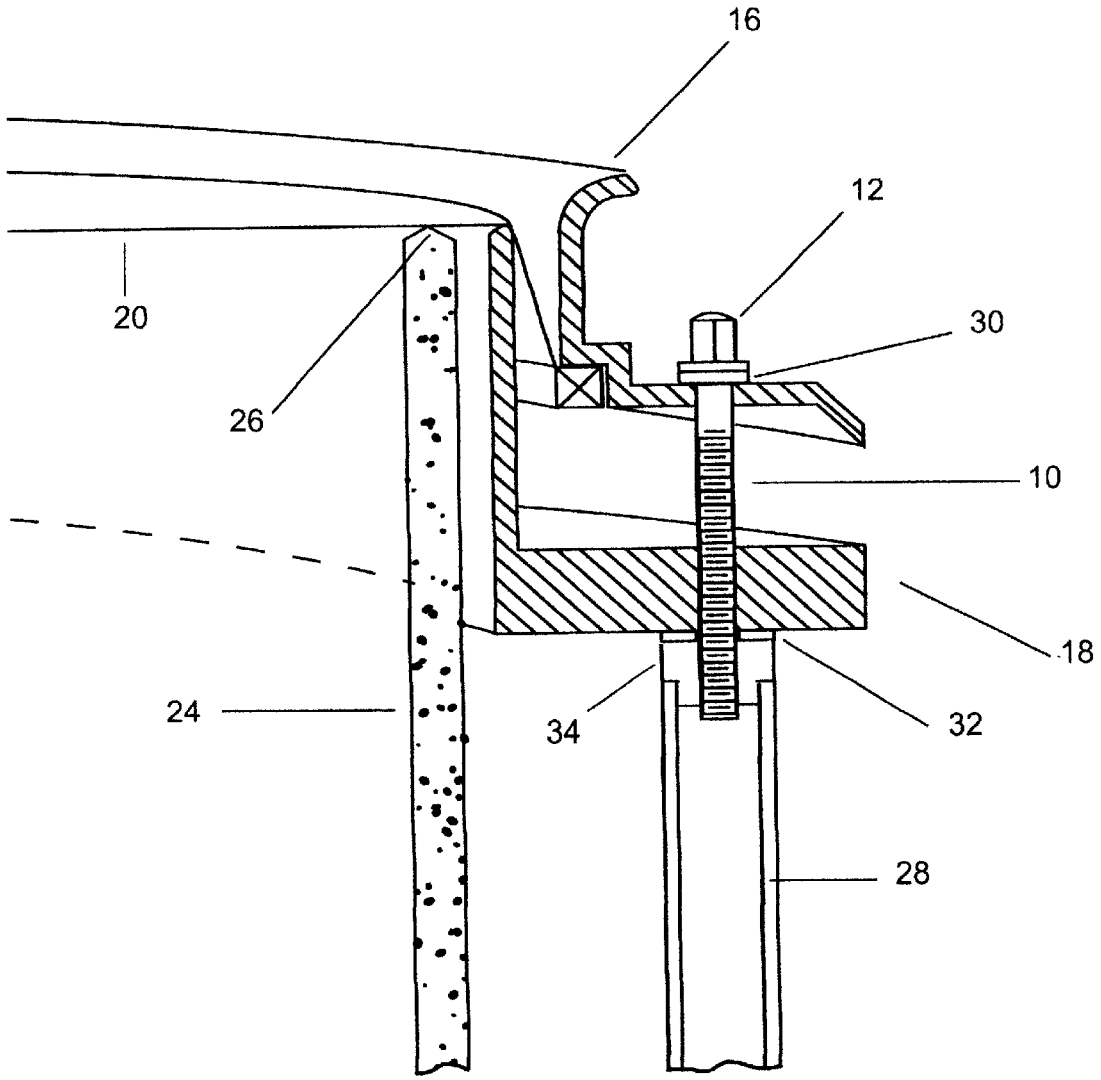

U.S. Pat. No. 4,714,002. Date: Dec. 22, 1987. Cleland uses a pair of overlapping hoops that hold the head in place and the inner hoop FIG. 4 Part No. 60 displays a notch. FIG.4. No. 45, 46 that receives the end of the shell and thereby becomes an extension of the shell. The shell never contacts the head directly.

U.S. Pat. No. 4,334,458. Date: Jun. 15, 1982. Grauso. Displays a band FIG. 4 No. 20, that inserts into a notch in the shell No. 32 and contact the shell therefore not maintaining a free floating shell.

U.S. Pat. No. 5,357,838. Date: Oct. 25, 1994. Kurosaki. Fastening elements are connected to each other by long tubes, which are directly and mechanically connected to the shell.

U.S. Pat. No. 4,869,146. Date: Sep. 26, 1989. Bonsor. An intermediate hoop No. 16 notched No. 18 to receive shell. Shell does not contact head directly.

U.S. Pat. No. 5,447,087. Date: Sep. 5, 1995. Hawes et al. Once again intermediate hoops No. 12 upper and No. 11 lower notched No. 13 to except drum shell. Shell does not contact head directly.

U.S. Pat. No. 5,413,002. Date: May 9, 1995. Sleishman shows a drum having an outer band which is bolted to the center part of the shell as shown in FIG. 6 Part 60, FIG. 4 Part 39 and FIG. 1 Part 15 attached to shell by bolt 16.

Figure 3:
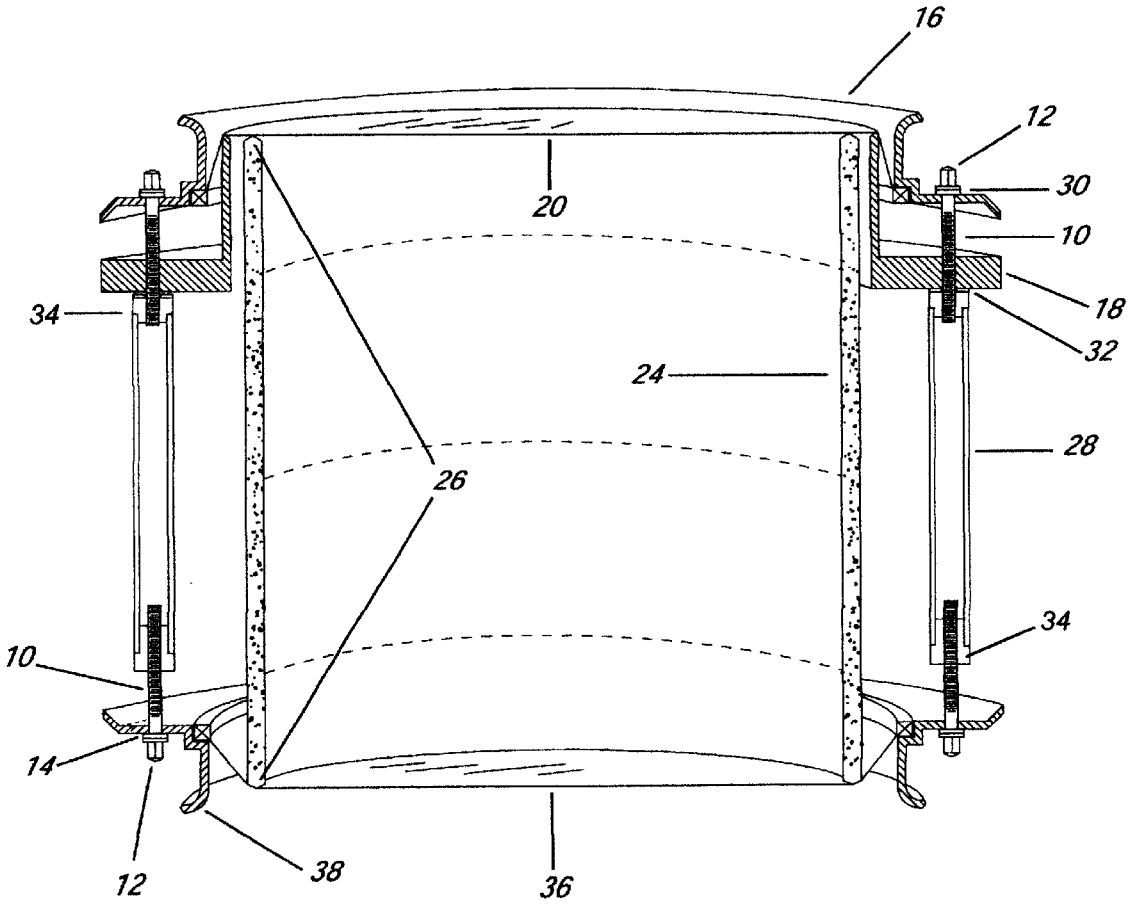

U.S. Pat. No. 4,570,526. Date: Feb. 18, 1986. Hoshino. In this drum anchors are mounted to the shell No. 41 by means of a screw through the shell No. 65. This is best seen in FIG. 3 Sheet 2 of 2.

Heretofore, no drum design provided for a truly suspended drum shell. It would be quite advantageous to have a drum shell freely suspended and without piercing of the shell as to provide enhanced sound emanating from the musical drum.

Objects and Advantages

Accordingly, besides the objects and advantages of the musical drum described in my above patents, several objects and advantages of the present invention are:

(a) Reduced cost of hardware.

(b) Reduced labor, no drilling of holes or mounting of hardware to shell.

(c) Larger variation in shell construction, thickness and materials not dictated by need to support mounting hardware and tension.

(d) Shape of shells, sides of shells does not need to be parallel.

(e) Quick exchange of shell; removing one rim and head allows shell to lift out while pre-tensioned head remains in tune.

(f) Reduce transmitted vibrations from upper rim to lower rim.

(g) Utilization of existing head, rim, shells and tension rods.

(h) Mounting of drums by attachment of plate to intermediate rim.

(i) Lighter weight drums

Further objects and advantages are that shells primarily constructed of plywood has been used for reasons of strength. Multiple layers of wood act to sound much in the same way as layers of clothing react to cold; they insulate, therefore reducing sound. Without the necessity to physically attach hardware to the shell, shells can now be made thinner and have a single ply and solid wood. Another disadvantage of physically attaching hardware to the shell is that the tension of the head and rim bearing on the tension mounts causes the shell to warp and go out of round.

References to the effect of the above-mentioned are as follows:

(a) Drum Shells, Where It All Starts by Woody Thompson, Shop Talk, Modern Drummer September 1993.

(b) Understanding Drums, by Paul Matcott, Shop Talk, Modern Drummer, June 1985.

(c) Drums: An Engineering Analysis: Part 1 and 2 by Spiros A. Psarris, Modern Drummer.

SUMMARY

The application of a principle of physics to a musical drum whereby an equal tensioning of opposing heads is obtained without physical attachments or piercing of the drum shell in any manner.

DRAWINGS

Drawing Figures

In the drawings, closely related figures have the same number but different alphabetic suffixes.

FIG. 1 Front view of musical drum.

Figure 2:
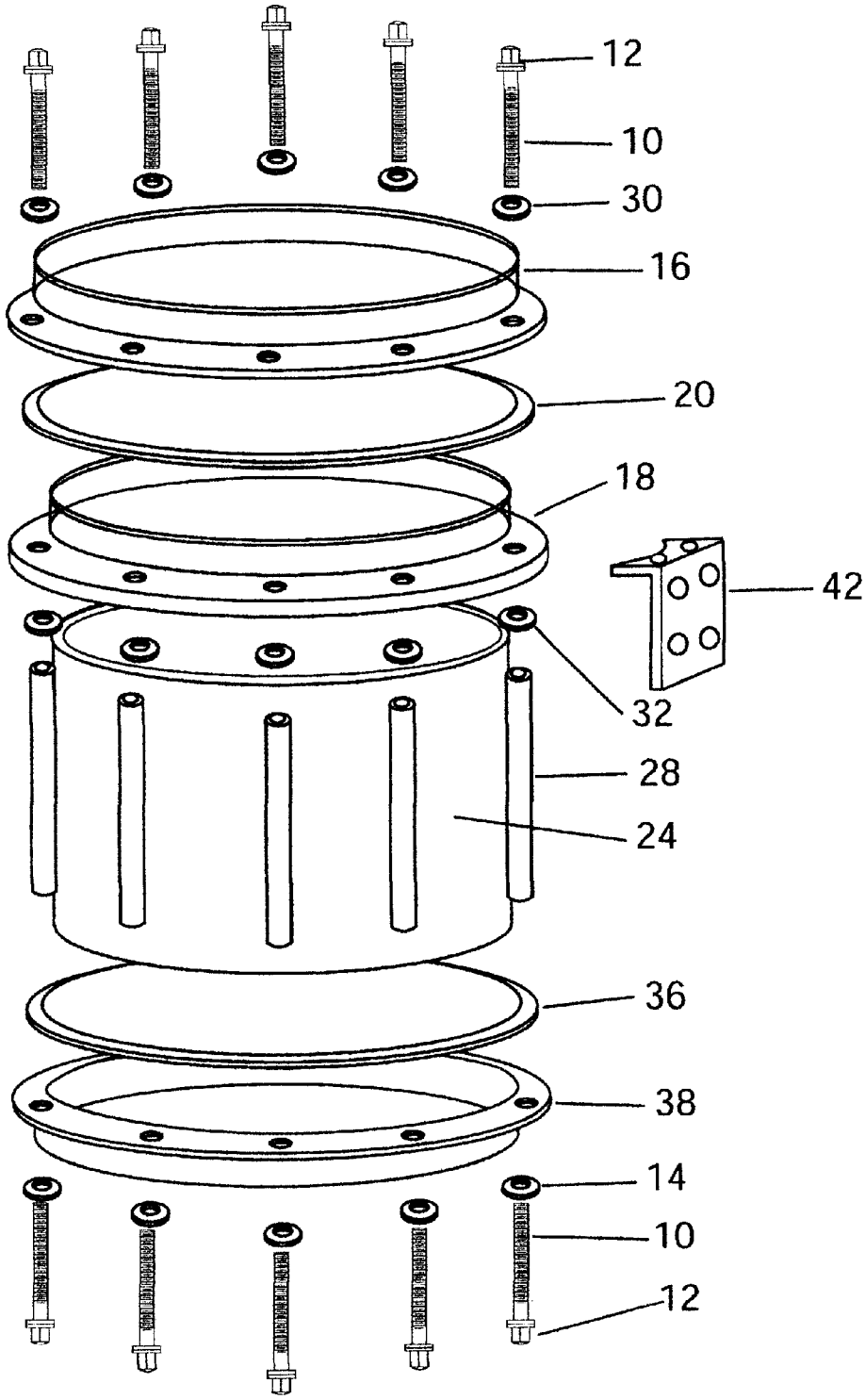

FIG. 2 Exploded view of drum and parts in relation to each other.

FIG. 3 Cross section of rims, shell and tension rods and post.

FIG. 4 Close up of FIG. 3, upper tension assembly.

Figure 5:
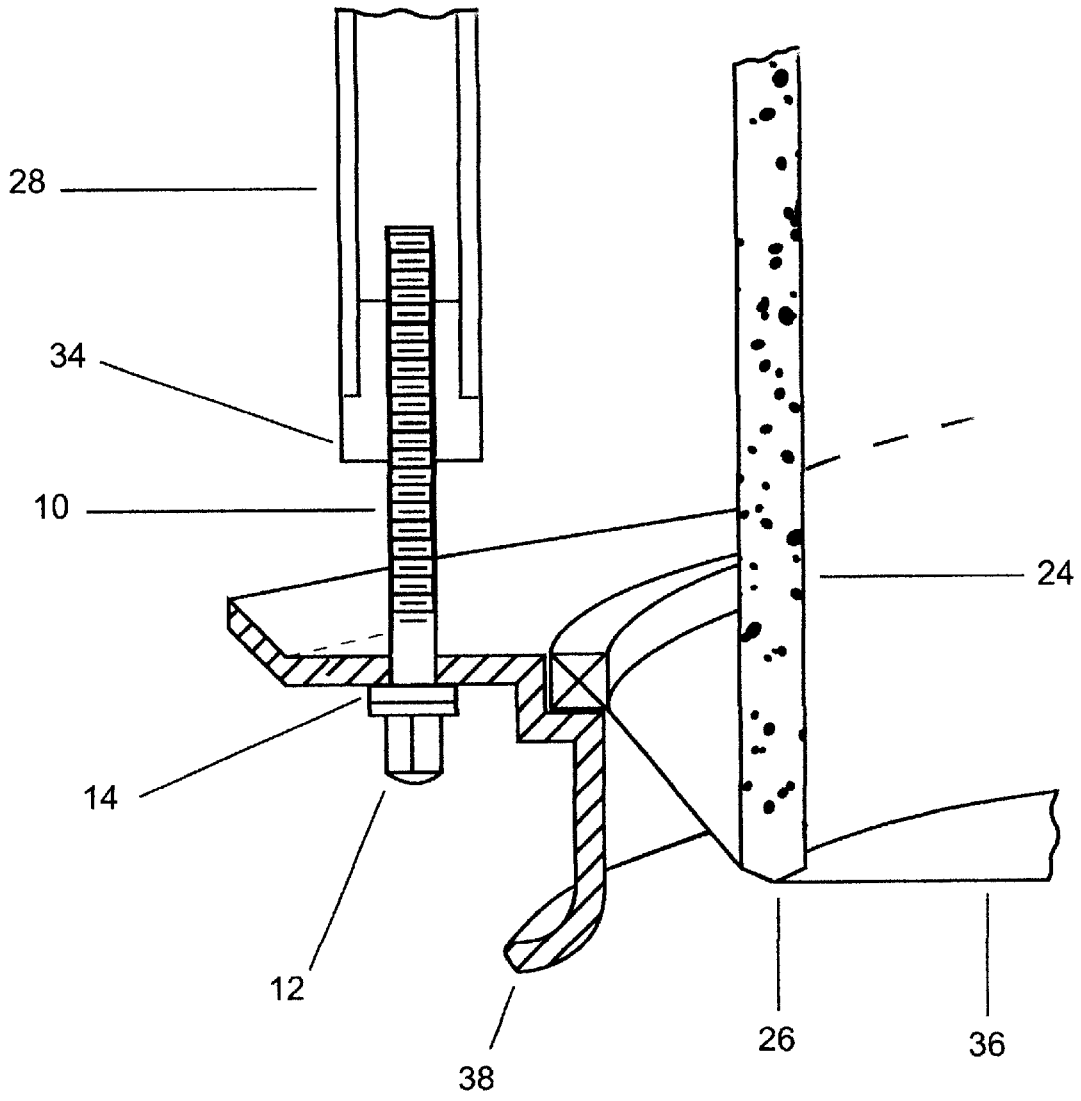

FIG. 5 Close up of FIG. 3, lower tension assembly.

REFERENCE NUMERALS IN DRAWINGS

| | |
|---|---|
| 10 Tension rod | 12 Key head |
| 14 Vibration washer (notched) | 16 Upper hoop (rim) |
| 18 Intermediate hoop | 20 Upper head |
| 24 Shell | 26 Bearing edge of shell |
| 28 Tension post | 30 Flat washer |
| 32 Lock washer | 34 Tension rod receiver |
| 36 Lower head | 38 Lower hoop (rim) |
| 40 Musical drum | 42 Mounting bracket |

DETAILED DESCRIPTION OF THE INVENTION

Referring to the drawings, in all of which like parts are designated by like reference numbers, the musical drum 40 (FIG. 1) of the present invention, is shown. The drum shell 24 is formed of any conventional material, such as, wood, plastic, metal, for example, fiberglass and cast aluminum. The drum shell 24 is generally cylindrical in shape. Drum head 20 is disposed over the top of the intermediate hoop 18, and the top end of the shell 24. The heads 20 and 36, are generally composed of animal skin or a plastic material, for example, polyvinylchloride or polyurethane teraphthalate ("MYLAR"), etc. The drum heads 20, 36 are held in place by hoops, upper and lower, 16 and 38 respectively, disposed circumferentially around the heads. A plural of tension rods can secure the upper hoop 16 over the head 20 which is placed over intermediate hoop 18. The tension rods pass through both upper hoop 16 and intermediate hoop 18 and are received into threaded tension post 28. Flat washer 30 is placed between flange of tuning rods 10 and upper hoop 16. Lock washer 32 is placed between intermediate hoop 18 and tension post 28. Shell 24, being of a smaller outside diameter than the inside diameter of intermediate hoop 18, is placed to contact directly to upper head 20. Sufficient space between the inside diameter of intermediate hoop 18 and the outside diameter of shell 24 should be sufficient so that no contact of the shell 24 with intermediate hoop 18 is possible. Shell 24 should contact upper head 20 alone. When shell 24 is in position to upper head 20, the opposing side of shell 24 receives lower head 36 which is held in position by lower hoop 38 and connected to tension post 28 by means of a plural of tension rods 10 through vibration washer 14 and received by tuning post 28 tension rod receivers 34.

Generally any type of drum can be suspended in accordance with this system. Drum mounts 42 can be attached to intermediate hoop 18 and in the case of snare drum, snare strainer mechanism (not shown) can also be fastened to intermediate hoop 18, allowing for removal of physical contact with the shell 24, which is the common application for conventional drums. The mounting of these items to the intermediate hoop 18 preserves the integrity of the shell 24 having no physically mounted hardware or piercing of the shell 24, leaving it suspended by the shell's bearing edges 26 in contact with upper head 20 and lower head 36 only.

Advantages

From the description above, a number of advantages of using this principle of physics become evident:

(a) Time in manufacturing—aligning and drilling of shell to attach hardware is now eliminated.

(b) With the removal of one head, the shell of the drum can be removed and exchanged.

(c) Pre-tensioned head remains tuned even if lower head and shell is removed.

(d) Pre-tensioned head can be tuned to the timber of the shell while shell is out of drum.

(e) Reduced weight of drum overall.

(f) Larger variety in shell construction; shell does not need to meet requirements to support mounting of hardware.

(g) Shape of shell can be varied; no longer is it required for shell size to be parallel.

(h) Drums can be of a smaller size and still produce the sounds of a larger drum.

Operation of Invention

This invention relates to a principle of physics applied to a musical drum 40 (FIG. 1), and a means which allows the tensioning of the upper head 20 and lower head 36 (FIG. 2) to different degrees of rigidity without physical attachment or penetration to the shell 24 (FIG. 2). The shell 24 is best seen in FIG. 3 where it is in contact with the upper head 20 and lower head 36.

The principle of physics applied to this drum 40 is one in which a downward pressure applied to the upper drum head 20 produces a rigidity and utilizes the principle of stored energy. To achieve this physical state, the upper drum head 20 is placed over intermediate hoop 18 and held in place by rim 16. A plural of tension rods 10 passes through flat washer 30 and orifice in rim 16 and intermediate hoop 18. These tension rods 10 are threaded into tension receiver 34 and tension posts 28 with lock washers 32 between tension receiver 34 and bottom surface of intermediate hoop 16. This assembly allows the tensioning of the head 20 between the rim 16 and intermediate hoop 18 around the perimeter of the head 20. This action produces an equal and opposite reaction, the reaction being the tensioning of head 20. Therefore, if action is equal to reaction, then the reaction (head tension) can support an opposing action. Utilizing the tension of head 20, the shell 24 can be placed in contact with head 20 and the opposing head 36 and rim 38 can be tensioned against head 20 from a lesser to equal tension without affecting head 20. For example, if the downward pressure on the circumference of head 20 created by upper hoop 16 against intermediate hoop 18 produces sixty pounds of tension across head 20, then lower head 36 can be mounted on the opposing side of the shell 24 and be tensioned by hoop 38 and tension rods 10 from zero to sixty pounds.

The head 20 being tensioned between the concentric rim 16 and intermediate hoop 18 holds the head rigid. A shell 24 being of a smaller outside diameter than the inside diameter of the intermediate hoop 18 can now be inserted so that shell 24 edge will contact the head 20, leaving sufficient clearance between shell 24 and intermediate hoop 18 to prevent any contact between these elements. The opposing edge of shell 24 receives lower head 36 and is held in place by lower rim 38. Tension rod 10 passing through notched vibration washer 14 pass through orifice of rim 38 and connects to tension receiver 34 of opposing end of tension post 28. This allows the tensioning of the lower head 36.

Notes: Downward pressure equals tension, therefore, tension also equals downward pressure. Percentage of tension will support equal downward pressure without changing, fixed percentage of tension will not be affected and therefore able to support any lesser downward pressure. If 60 pounds of downward pressure creates 60 pounds of tension, that tension can support secondary tension of an equal or lesser amount. Once secondary tension becomes equal, then primary tension will increase, equal to the new overcoming greater tension. Example, primary tension 60 pounds. Secondary tension 0 to 60 pounds. At this point, if secondary tension is increased, primary tension will also increase equally. If primary tension is 60 pounds, and secondary tension is 40 pounds, and primary tension is increased to 70 pounds, ten pounds more, secondary tension will also increase by ten pounds, therefore becoming 50 pounds.

CONCLUSION, RAMIFICATIONS, AND SCOPE

Thus the reader will see that the application of this principle of physics to a musical drum allows the shell of a drum to resonate freely, therefore producing a fuller and more pleasing acoustical sound.

While my above description contains many specificities, these should not be construed as limitations on the scope of the invention, but rather as an exemplification of one preferred embodiment thereof. Many other variations are possible. For example: there are other ways of pre-tensioning one of the heads. The use of that head as an opposing bearing tension can produce the same physical result.

Accordingly, the scope of the invention should be determined not be the embodiments illustrated, but by the appended claims and their legal equivalents.

I claim:

1. A drum head tensioning assembly comprising any combination inner intermediate hoop and outer hoop rim, said inner intermediate hoop being essentially L-shaped in cross sectional view and comprising of vertical flange, and outward directed foot-flange, said outer hoop rim overlaps the upper portion of said inner intermediate hoop;

(a) an annular step formed in the lower inner edge of said outer rim to accommodate a locking hoop, said drum skin being secured between said locking hoop and said annular step;

(b) means co-acting with said rims for varying the tension of said skin by varying the extent of overlap between said rims;

(c) a drum shell with an outside diameter being smaller than the inside diameter of said intermediate hoop;

(d) said drum shell upper perimeter bearing edge passing through intermediate hoop to contact said upper head said drum shell being of smaller outside diameter to insure avoidance of contact with larger inside diameter of said intermediate hoop;

(e) second opposing drum head placed over opposite perimeter bearing edge of said drum shell secured by second outer hoop rim adapted to maintain other drum skin in abutting force against lower perimeter edge of said drum shell said drum shell being of cylindrical configuration;

(f) a tension varying means in the form of a set of aligned apertures in said outer ring of said foot flange and threadable tension rod extending through said apertures for torquing down the assembly in overlapping position with the intermediate rim and received by a plural of aligning tension posts extending parallel to said shell;

(g) said shell being placed inside intermediate hoop with said perimeter bearing edge contacting upper head, second hoop rim has been tensioned to meet with opposing drum head against lower part of drum shell perimeter bearing edge;

(h) a plural of tuning posts to interlock upper outer said rim and said intermediate hoop to said lower head and said secondary rim after said shell has been placed in assembly.

2. A drum as claimed in claim 1 in which the outer hoop rim and inner intermediate hoop tension the drum head in overlapping fashion applying the principle of physics known as sheer tension to create a condition of stored energy resulting in the by-product of rigidity;

(a) said shell as in claim 1 having a smaller outside diameter than said intermediate hoop inside diameter passes through inside intermediate hoop and outer perimeter bearing edge contacts pre-tensioned head;

(b) second opposing head and said second rim overlaps opposing perimeter bearing edge of shell and by means of tension posts utilizes physical properties of pre-tensioned opposing head to support tensioning of second said head and said rim to tension secondary said head and rim from lesser to equal tension of pre-tensioned head.

3. A drum as claimed in claim 1 which utilizes the principle of physics whereby a means of pre-tensioning of a head allows the opposed bearing tensioning of a second head to an unequal tension without attachments, piercings or bearing of hardware to the said drum shell thereby allowing the said shell to resonate freely without restrictions and yields improved acoustical characteristics.

* * * * *